US005742656A

United States Patent [19]

Mikulak et al.

[11] Patent Number: 5,742,656

[45] Date of Patent: Apr. 21, 1998

[54] GAMING TOKEN TRAY EMPLOYING ULTRASONIC TOKEN COUNTING

[75] Inventors: James K. Mikulak; Paul H. Clark, both of Austin, Tex.; Carey W. Starzinger, Salem, Oreg.; Barry H. Wong, Vancouver, Wash.

[73] Assignee: The Casino Software Corporation of America, Salem, Oreg.

[21] Appl. No.: 621,186

[22] Filed: Mar. 21, 1996

[51] Int. Cl.[6] ..... G06M 7/00

[52] U.S. Cl. ..... 377/7

[58] Field of Search ..... 377/7

[56] References Cited

U.S. PATENT DOCUMENTS

| | | | |
|---|---|---|---|
| 3,825,729 | 7/1974 | Menke | 235/92 CN |
| 4,026,309 | 5/1977 | Howard | 133/8 R |
| 4,755,941 | 7/1988 | Bacchi | 364/412 |
| 4,774,841 | 10/1988 | Chadwick | 73/597 |
| 5,021,027 | 6/1991 | Bremer | 453/58 |
| 5,408,090 | 4/1995 | Craddock | 250/222.1 |
| 5,454,016 | 9/1995 | Holmes | 377/6 |

*Primary Examiner*—Margaret Rose Wambach
*Attorney, Agent, or Firm*—Stoel Rives LLP

[57] ABSTRACT

A chip (12) counter (10) employs an ultrasonic distance measuring system (40) to determine the number of chips in a stack (54, 56) in a chip tray (16) channel (14). A computer (32) initially stores an average chip thickness (T) and receives distance data from the ultrasonic distance measuring system indicative of a first distance ($D_1$) to the bottom of an empty channel. To count chips, the computer repeatedly receives data from the ultrasonic distance measuring system indicative of a second distance ($D_2$) to the top of the stack of chips in the channel. The computer subtracts the second distance from the first distance to determine a height of the stack of chips and then divides the height by the average chip thickness to provide a continuous count of the number of chips in the channel. In a multichannel chip tray, each channel has a distance measuring transducer, and a multiplexer (28) scans all the transducers to provide the computer with second distance data for all channels in the chip tray.

14 Claims, 3 Drawing Sheets

GAMING TOKEN TRAY EMPLOYING ULTRASONIC TOKEN COUNTING

TECHNICAL FIELD

This invention relates to counting gaming tokens stored in a tray and more particularly to automatically counting the tokens by employing ultrasonic echo ranging techniques.

BACKGROUND OF THE INVENTION

There are previously known apparatus and methods for storing and automatically counting disk-shaped articles, such as coins and gaming tokens (hereafter "chips").

In particular, U.S. Pat. No. 3,825,729, of Menke, for CASE BOX WITH COIN COUNTER describes a cash box having a switch actuated counter that is operated by coins passing through a slot and actuating the switch. The number and/or value of coins in the cash box is accumulated by the counter. However, the cash box is intended to secure the coins, and the counter is, therefore, not adapted to automatically decrement as individual coins are removed from the cash box. Therefore, such a system is not suitable for use in gaming applications in which the number of chips in the tray is constantly increasing and decreasing.

It is also known to use the height of a stack of coins to indicate their total value. U.S. Pat. No. 5,021,027, of Bremer, for COIN COMPUTER WITH INTEGRAL COIN INDICIA describes a transparent tubular member shaped to scoop up and hold a stack of coins. The tubular member includes graduations on its side indicative of the height, and thereby, the value of the stack of coins. However, the tubular member is a simple mechanical device without any automated means for communicating the number of coins in the stack to a computer, register, or other accounting device.

Automated means of counting the number of disk-shaped articles in a stack are described in U.S. Pat. No. 5,408,090, of Craddock, for APPARATUS FOR COUNTING CAN ENDS OR THE LIKE ("the Craddock patent") and U.S. Pat. No. 4,026,309, of Howard, for CHIP STRUCTURE ("the Howard patent").

The Craddock patent describes arranging can ends in a stack, angularly illuminating the peripheral edge regions of the can ends, and detecting variations in the reflected light intensity indicative of gaps between adjacent can edges. The illumination source and the detector are mechanically scanned past the stack of can ends and the detected light variations are electronically counted to indicate the number of can ends in the stack.

The Howard patent describes arranging a stack of chips in a trough that has a slit in its bottom through which a scanning light beam illuminates the stack of chips. Each chip has a highly emissive strip imbedded therein that is exposed at the peripheral edge of the chip. The scanning light beam reflects off the highly emissive strips, and the reflected light variations are electronically counted to indicate the number of chips in the stack. The highly emissive strip reflects light at a particular wavelength depending on the value of the chip being counted, thereby providing a means of determining both the number and the value of mixed chips in a stack.

Unfortunately, the Craddock and Howard patents require relatively cumbersome scanners. Therefore, another prior chip counting means employs fixed arrays of light-emitting diodes ("LEDS") and photo-detectors arranged to reflect light rays off the peripheral edges of individual chips. While this arrangement has no moving parts, it unfortunately requires a separate LED and detector for each chip position.

Unfortunately, all of the chip counters that detect light reflected from a peripheral edge of the chips may not reliably count chip styles that have an uneven peripheral edge. Moreover, dirt and dust accumulate near the bottom of the chip stack causing potentially unreliable counting, and the fixed positioning of the arrays of LEDS cannot be readily adapted to variations in chip wear and to different chip styles, and thicknesses employed at different gaming sites.

What is needed, therefore, is a simple, reliable, chip-counting apparatus and method that eliminate dirt and dust problems and that are adaptable to variations in chip wear, style, and thickness.

SUMMARY OF THE INVENTION

An object of this invention is, therefore, to provide an improved apparatus and method for counting the number of chips stacked in a chip tray.

Another object of this invention is to provide a chip counting apparatus and method that reduce dirt and dust problems.

A further object of this invention is to provide a chip counting apparatus and method that are adaptable to variations in chip wear, style, and thickness.

A chip counter of this invention employs an ultrasonic distance measuring device to determine the number of chips in a stack in a chip tray channel. A computer initially stores an average chip thickness and receives data from the ultrasonic distance measuring device indicative of a first distance to the bottom of an empty channel. To count chips, the computer repeatedly receives data from the ultrasonic distance measuring device indicative of a second distance to the top of the stack of chips in the channel. The computer subtracts the second distance from the first distance to determine a height of the stack of chips and then divides the height by the average chip thickness to provide a continuous count of the number of chips in the channel.

The chip counting tray may include multiple chip holding channels and associated ultrasonic distance measuring devices to provide a multichannel chip stack counting capability. Each of the multiple chip stacks may be configured to hold a particular value, style, and thickness of chip. The computer initially stores an average chip thickness for the chips in each channel and receives data from a multiplexer that scans the ultrasonic distance measuring devices associated with each channel to provide data indicative of a first distance to the bottom of each empty channel. To count chips, the computer receives from the multiplexer data from each ultrasonic distance measuring device indicative of a second distance to the top of the stack of chips in each channel. The computer calculates the number of chips in each channel and may further totalize the values of chips in each channel and in the entire chip tray.

Additional objects and advantages of this invention will be apparent from the following detailed description of a preferred embodiment thereof that proceeds with reference to the accompanying drawings.

DETAILED DESCRIPTION OF A PREFERRED EMBODIMENT

Figure 1:
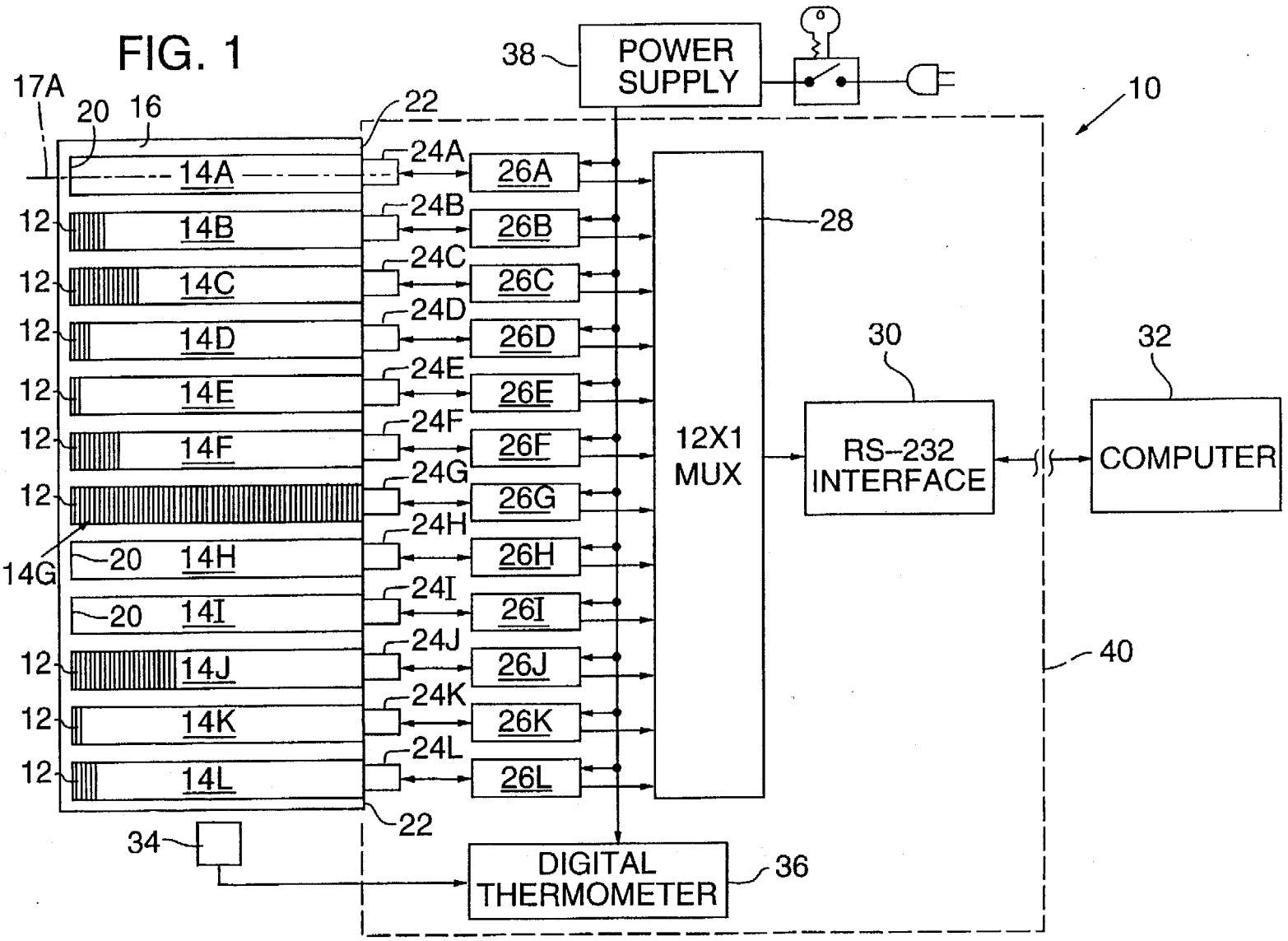
FIG. 1 is a simplified overall pictorial and schematic circuit view of a chip counting apparatus of this invention.

FIG. 1 shows a chip counter 10 of this invention that counts chips 12 stacked in substantially semi-cylindrical troughs 14A through 14L (collectively "troughs 14") formed in a chip tray 16. Typical stacks of chips 12 include 60 chips. Also referring to FIG. 2, each of troughs 14 has a longitudinal axis 17A through 17L (only two shown) that is slightly inclined at an angle 18 from a horizontal reference line 19 to prevent chips 12 from tipping over and to facilitate a tight stacking of chips 12. The elevationally lower ends of troughs 14 are referred to as lower ends 20, and the elevationally higher ends of troughs 14 are referred to as upper ends 22.

Chips 12 are preferably conventional gaming tokens, which have a diameter of about 39.7 millimeters (1.56 inches) and an average thickness T of about 3.175 millimeters (0.125 inch). Chips 12 have a thickness variation of about ±0.13 millimeter (±0.005 inch).

Chip tray 16 is preferably a model BJ blackjack tray with a locking security cover (not shown), both of which are manufactured by Vegas Security Company, Las Vegas, Nev.

Upper ends 22 of troughs 14 are fitted with ultrasonic transducers 24A through 24L (collectively "transducers 24") that are connected to associated distance measurement circuits 26A through 26L (collectively "circuits 26"). Transducers 24 and circuits 26 cooperate to transmit 38.5 kilohertz acoustic waves along longitudinal axes 17A through 17L. The acoustic waves are reflected off either lower end 20, as in troughs 14A, 14H, and 14I, or off the nearest of chips 12 as in the other ones of troughs 14. Circuits 26 determine the round-trip propagation delay time and generate digital distance data indicative of the distances between transducers 24 and the closest of lower ends 20 and chips 12 in each of troughs 14.

A multiplexer 28 scans the distance data generated by circuits 26 and provides time division multiplexed samples of the distance data to an interface 30 that is preferably in 9,600 baud RS-232 serial communication with a computer 32, such as a conventional IBM-compatible personal computer.

A temperature sensor 34 in proximity to chip tray 16 provides a temperature signal to a digital thermometer 36 that generates temperature data which are conveyed to each of circuits 26 to temperature correct the distance data each generates.

A 15 volt, three ampere power supply 38 powers transducers 24, circuits 26, multiplexer 28, interface 30, and digital thermometer 36, which collectively form a 12-channel distance measurement system 40 (hereafter "system 40"). Power supply 38 is preferably a model B15G300-V-R manufactured by Acopian, Inc. in Easton, Pa. System 40 is preferably a model ML-102-2 manufactured by Cosense, Inc. in Happauge, N.Y. System 40 can measure distances in a range from about 12.7 millimeters (0.5 inch) to about 24.1 centimeters (9.5 inches) and a measurement accuracy of about ±0.13 millimeter (±0.005 inch). The typical stack of 60 chips 12 is about 19 millimeters (7.5 inches) high, which is well within the distance-measuring range of system 40. Unlike some other ultrasonic distance measuring systems, system 40 generates a pencil-thin acoustic wave which effectively prevents adjacent channel reflected signals from degrading the distance measuring accuracy. Also, its 38.5 kilohertz operating frequency is sufficiently high to prevent humans from hearing the high-frequency "screech" generated by some types of transducers.

Figure 2:
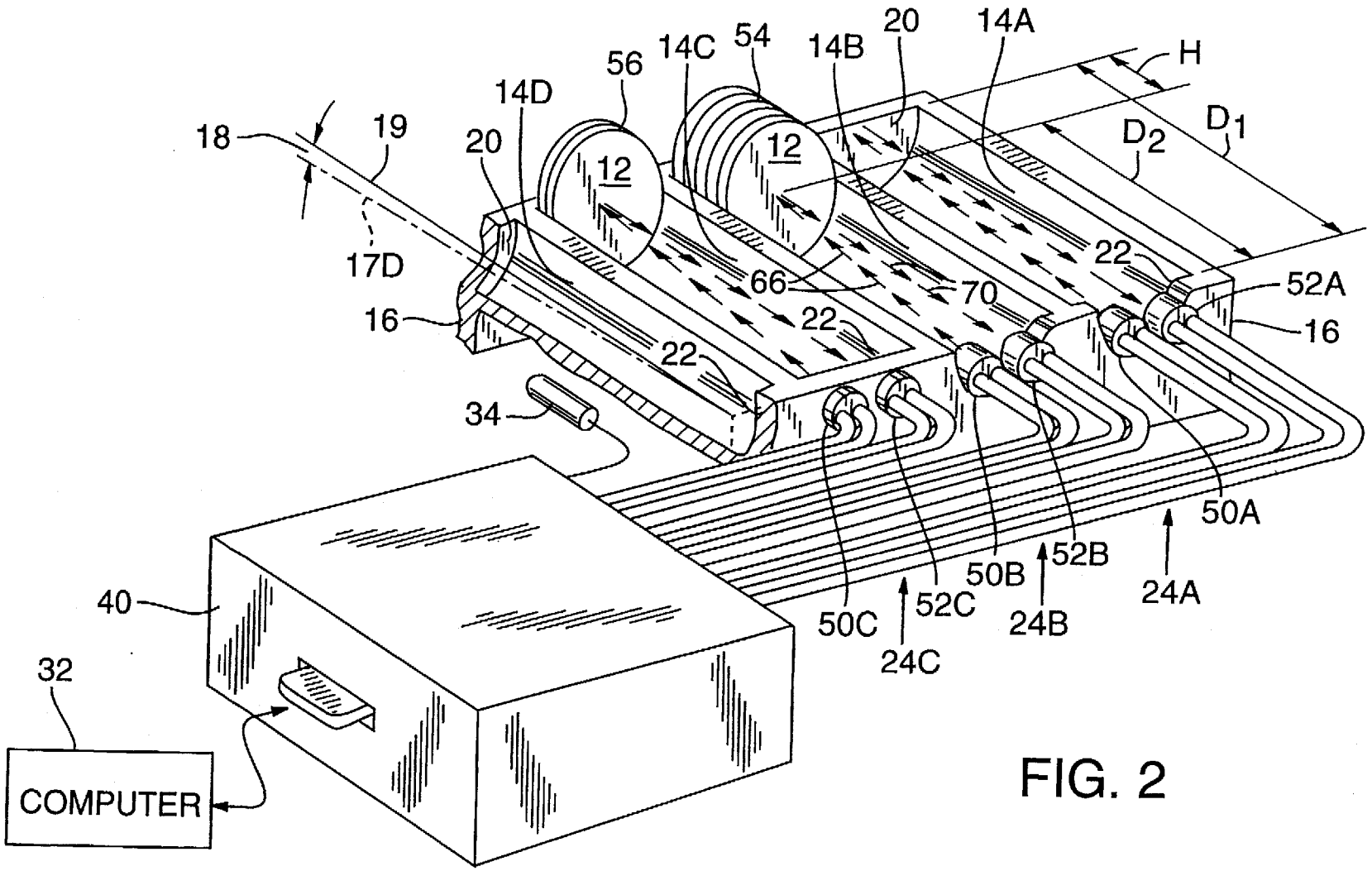
FIG. 2 is an isometric pictorial view of a three channel portion of a chip tray partly cutaway to reveal ultrasonic transducers arranged to measure distances to chips stacked in the channels.

A preferred chip counting process is described below with reference to FIGS. 2 and 3. To clarify the description, FIG. 2 shows in more detail channels 14A, 14B, and 14C of chip tray 16; and transducers 24A, 24B, and 24C are shown separated into emitters 50A, 50B, and 50C and corresponding sensors 52A, 52B, and 52C. Channel 14A contains none of chips 12, channel 12B contains a six chip stack 54 of chips 12 (hereafter "stack 54"), and channel 12C contains a two chip stack 56 of chips 12. Stacks 54 and 56 are merely exemplary of chip stacks that can include any number of chips 12 from zero chips to preferably 60 chips, but up to about 76 chips. Of course, the number of chips may vary depending on their thickness and thickness variation, the channel length, and the effective range and accuracy of system 40.

Figure 3:
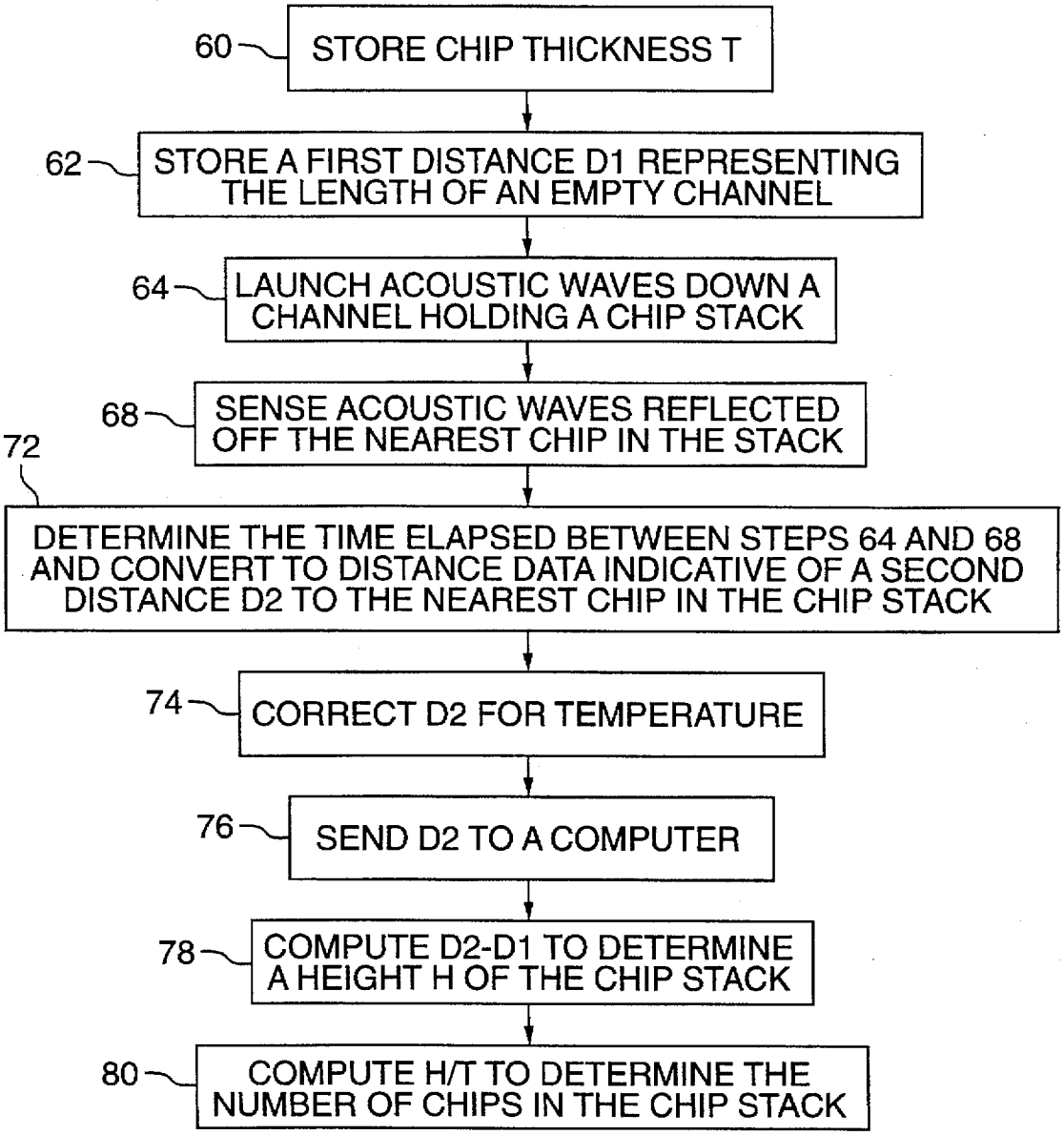
FIG. 3 is a flow chart representing a chip counting method of this invention.

Referring to FIG. 3, the chip counting process is described for only channel 14B, but it is understood that a multichannel implementation is readily accomplished as described above by employing multiplexer 28 (FIG. 1) of system An initialization block 60 represents computer 32 storing data indicative of chip thickness T for chips 12 in stack 54.

An initialization block 62 represents computer 32 storing data indicative a first distance $D_1$ from transducer 24C to lower end 20 of channel 14B. Distance $D_1$ is either entered into computer 32 manually or by receiving data from system 40 representative of distance $D_1$. Such data may be generated for channel 14B when stack 54 is removed from channel 14B or by measuring the corresponding distance $D_1$ of a known empty channel, such as, for example, channel 14A.

An emitter pulsing block 64 represents system 40 causing emitter 50B to launch acoustic waves 66 down channel 14B toward stack 54.

A sensor receiving block 68 represents sensor 52B receiving reflected acoustic waves 70 from the nearest chip 12 of stack 54 and conveying a corresponding sensor signal to system 40.

A distance measuring block 72 represents system 40 determining the time elapsed between emitter pulsing block 64 and sensor receiving block 68, and converting the elapsed time into distance data indicative of a second distance $D_2$ from transducer 24C to the nearest chip 12 of stack 54.

A temperature correcting block 74 represents system 40 correcting the distance data to compensate for the speed of sound at a temperature sensed by temperature sensor 34.

A communicating block 76 represents system 40 sending the corrected distance data to computer 32. Alternatively, sensed temperature data may be communicated to computer 32, which may apply the temperature correction to the uncorrected distance data.

A subtracting block 78 represents computer 32 subtracting second distance $D_2$ from first distance $D_1$ to determine a height H of stack 54.

A dividing block 80 represents computer 32 dividing height H by chip thickness T to determine the number of chips 12 in stack 54.

Skilled workers will recognize that portions of this invention may be implemented differently from the implementations described above for the preferred embodiment. For example, ultrasonic transducers 24 may be attached to chip tray 16 or may be attached to a gaming table into which chip tray is fitted. In this implementation, chip tray 16 includes openings along upper ends 22 of channels 14 to accept transducers 24. Of course, particular implementations may be adapted for different sizes and shapes of chips, different numbers of channels, and different ultrasonic transducer frequencies and characteristics to suit particular article counting applications. Of course, a single transducer in each channel may be time division multiplexed to alternately emit and sense the ultrasonic waves.

It will be obvious to those having skill in the art that many changes may be made to the details of the above-described embodiment of this invention without departing from the underlying principles thereof. Accordingly, it will be appreciated that this invention is also applicable to article counting applications other than those found in the gaming field. The scope of the present invention should, therefore, be determined only by the following claims.

We claim:

1. A method for counting a number of gaming tokens in stacks of gaming tokens, the gaming tokens having a thickness, the method comprising:

providing multiple open gaming token troughs each having a longitudinal axis and first and second ends;

mounting an ultrasonic distance measuring transducer adjacent to the first end of each trough and orienting the ultrasonic distance measuring transducers to measure distances substantially along the longitudinal axis of each trough, each transducer having a beam substantially confined within its associated trough;

connecting each ultrasonic distance measuring transducer to a distance measurement system that is connected to a computer;

measuring a first distance $D_1$ between at least one ultrasonic distance measuring transducer and the second end of the associated trough;

storing $D_1$ and the thickness in the computer;

loading the stacks of gaming tokens in the troughs and against the second ends of the troughs;

measuring second distances $D_2$ between the ultrasonic distance measuring transducer and a nearest gaming token in each of the stacks of gaming tokens; and calculating in the computer the number of gaming tokens in each of the stacks of gaming tokens by employing data generated in the measuring and storing steps.

2. The method of claim 1 in which the calculating step comprises subtracting in the computer second distances $D_2$ from $D_1$ to determine heights H of each of the stacks of gaming tokens, and dividing in the computer heights H by T to determine the number of gaming tokens in each of the stacks of gaming tokens.

3. The method of claim 1 further including correcting second distances $D_2$ for a temperature sensed in proximity to the troughs.

4. The method of claim 1 further including providing a multiplexer in the distance measuring system adapted to sequentially carry out the measuring second distances step for the stacks of gaming tokens in the troughs.

5. The method of claim 1 in which the measuring a first distance $D_1$ step is carried out by the distance measurement system.

6. An apparatus for counting a number of gaming tokens in multiple stacks of gaming tokens, the gaming tokens each having a thickness, comprising:

multiple open gaming token troughs each having a longitudinal axis and first and second ends, each of the troughs securing a stack of gaming tokens against the second end;

an ultrasonic distance measuring transducer mounted adjacent to the first end of each trough and oriented such that each ultrasonic distance measuring transducer measures distances substantially along the longitudinal axis of its associated trough, each transducer having a beam width confined substantially within its associated trough; and a distance measurement system connected to the ultrasonic distance measuring transducers and to a computer for determining heights of the stacks of gaming tokens in the troughs and thereby the numbers of gaming tokens in the stacks.

7. The apparatus of claim 6 in which the second ends of the troughs are elevationally lower than the first ends of the troughs.

8. The apparatus of claim 6 further including a temperature sensor and a digital thermometer for temperature correcting data employed by the computer to determine the heights of the stacks of gaming tokens.

9. The apparatus of claim 6 in which each of the gaming tokens has a thickness that ranges from about 3 millimeters to about 3.3 millimeters.

10. The apparatus of claim 6 in which the number of gaming tokens in each of the stacks of gaming tokens ranges from zero to about 75 gaming tokens.

11. The apparatus of claim 6 in which the distance measurement system includes a multiplexer that samples the ultrasonic distance measuring transducers mounted adjacent to the first ends of each of the troughs such that the computer determines a height for each stack of gaming tokens in each trough and thereby the number of gaming tokens in each stack.

12. The apparatus of claim 6 in which the multiple gaming token troughs number about 12 troughs.

13. A method for counting a number of gaming tokens in a stack of gaming tokens, the gaming tokens having a thickness, comprising:

providing at least one substantially tubular gaming token channel having a longitudinal axis and first and second ends;

mounting an ultrasonic distance measuring transducer adjacent to the first end of each channel and orienting the ultrasonic distance measuring transducer to measure distances substantially along the longitudinal axis of the channel;

connecting each ultrasonic distance measuring transducer to a distance measurement system that is connected to a computer;

measuring a first distance $D_1$ between at least one ultrasonic distance measuring transducer and the second end of the associated channel;

storing $D_1$ and the thickness in the computer;

loading the stack of gaming tokens in the channel and against the second end of the channel;

measuring a second distance $D_2$ between the ultrasonic distance measuring transducer and a nearest gaming token in the stack of gaming tokens;

correcting the second distance $D_2$ for a temperature sensed in proximity to the channel; and calculating in the computer the number of gaming tokens in the stack of gaming tokens by employing data generated in the measuring, correcting, and storing steps.

14. An apparatus for counting a number of gaming tokens in a stack of gaming tokens, the gaming tokens each having a thickness, comprising:

a substantially tubular gaming token channel having a longitudinal axis and first and second ends, the gaming token channel securing the stack of gaming tokens against the second end;

an ultrasonic distance measuring transducer mounted adjacent to the first end of the channel and oriented such that the ultrasonic distance measuring transducer measures distances substantially along the longitudinal axis of the channel;

a distance measurement system connected to the ultrasonic distance measuring transducer and to a computer for determining a height of the stack of gaming tokens in the channel and thereby the number of gaming tokens in the stack; and a temperature sensor and a digital thermometer for temperature correcting data employed by the computer to determine the height of the stack of gaming tokens.

* * * * *